US006170961B1

(12) United States Patent
Knoch

(10) Patent No.: US 6,170,961 B1
(45) Date of Patent: Jan. 9, 2001

(54) ILLUMINATED CAKE STAND

(76) Inventor: Joanne J. Knoch, W4743 10th Rd., Westfield, WI (US) 53964

( * ) Notice: Under 35 U.S.C. 154(b), the term of this patent shall be extended for 0 days.

(21) Appl. No.: 09/330,552

(22) Filed: Jun. 11, 1999

(51) Int. Cl.[7] ..... F21V 33/00

(52) U.S. Cl. ..... 362/234; 362/253; 362/808; 108/23

(58) Field of Search ..... 362/234, 253, 362/806, 808; 108/23

(56) References Cited

U.S. PATENT DOCUMENTS

| | | |
|---|---|---|
| 1,707,539 | 4/1929 | Propp . |
| 1,847,687 | 3/1932 | Biertuempfel . |
| 2,921,691 | 1/1960 | Dembinski . |
| 3,690,610 | 9/1972 | Peirce . |
| 3,744,166 | 7/1973 | Rielle . |
| 3,814,032 | 6/1974 | McMains . |
| 3,843,220 | 10/1974 | Snider . |
| 4,069,772 | 1/1978 | Haapala . |
| 4,416,075 | 11/1983 | Bauer . |
| 4,947,722 | 8/1990 | Lewis . |

OTHER PUBLICATIONS

"Wilton Enterprises cake decorating 1999 yearbook,"© 1998 Wilton Industries, Inc., 2240 W. 75th Street, Woodridge, IL 60517, pp. Cover, 88, 95, 158, 160, 161, and 162. Exhibit A—lighted Cake Stand device.

*Primary Examiner*—Sandra O'Shea
*Assistant Examiner*—John Anthony Ward
(74) *Attorney, Agent, or Firm*—Lathrop & Clark LLP

(57) ABSTRACT

A wedding cake layer is highlighted by a transparent plastic light assembly illuminated by a string of miniature electric lights. The light assembly supports a cake on a transparent plastic tray in an elevated position. The light assembly has one or more transparent plastic tubes forming pillars which are affixed between a top plate and a bottom plate. The plates have pillar entry holes such that a looped strand of lights may pass from the underside of the bottom plate to the top side of the top plate and be affixed thereto. The cake tray has downwardly extending feet which are received within cylindrical protrusions on the top plate. The cake tray has a peripheral rim through which the illuminated miniature lights are visible. An inverted cake tray is positioned beneath the bottom plate such that the feet of the inverted tray engage downwardly extending protrusions on the bottom plate. An electric cord extends from the lighted stand between the bottom plate and the inverted cake tray to be connected to another similar cake support or to an extension cord for connection to a power supply. The inverted tray may be disposed on a tabletop or on an underlying cake layer.

16 Claims, 2 Drawing Sheets

ILLUMINATED CAKE STAND

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to supports for baked goods in general, and to assemblies for supporting elevated cake layers in particular.

A wedding celebration is a momentous occasion, not only for the bride and groom, but also for the families, friends, and acquaintances of the married couple. The importance of the event is marked in numerous ways: the distinctive garb of the wedding party, the provision of music, dancing, floral arrangements, table decorations, food and drink. Pride of place among the table decorations and ornaments is accorded the wedding cake. The wedding cake, in addition to serving as a conclusion to the wedding meal, stands as a prominent symbol of the event, usually in full view of the participants, throughout the time prior to and during the consumption of the wedding lunch or dinner.

Because of its importance, significant care and expense are invested in providing a wedding cake which is not only satisfying to eat, but attractive to look upon. Regardless of the quantity of cake required to satisfy the guests, the symbolic importance of the cake often requires that it extend vertically above the tabletop to serve as an eye-catching centerpiece. Various cake supports and cake stands have been devised to separate the layers of the cake into an imposing structure. These cake supports may be formed of metal or plastic and, in addition to adding structural rigidity to a multilayer cake, also increase the visual volume of the cake assembly without unduly adding to the number of servings. Modular cake stands provide for rapid assembly of the cake and convenient transportation from the bakery to the reception hall. Cake trays formed of molded transparent plastic to simulate the appearance of cut glass may have downwardly protruding legs which support the tray on the tabletop or on tubular plastic pillars.

The importance of the wedding cake calls for prominent lighting. However, the overhead lighting within a banquet hall cannot always be accurately controlled. Furthermore, because the cake is an edible product, usually iced with sugar-based frosting, it should be protected from elevated temperatures, such as might be generated by the long-term directing of a spotlight. Wax candles with their flickering flames have been a traditional way of calling attention to a cake. However, burning candles require supervision, and present a potential fire hazard in crowded locations. Moreover, wax from the candles may drip onto the cake surface or the surfaces of the serving plates causing an unsightly mess.

What is needed is a support for an elevated cake which securely holds the cake layer while drawing visual attention to itself.

SUMMARY OF THE INVENTION

The cake support of this invention has a transparent plastic light assembly illuminated by a strand of miniature electric lights. The light assembly supports a cake on a transparent plastic tray in an elevated position. The light assembly has one or more transparent plastic pillars or tubes which are affixed between a top plate and a bottom plate. The plates have pillar entry holes such that the double strand of lights may pass from the underside of the bottom plate to the top side of the top plate and be affixed thereto. The cake tray has downwardly extending feet which are received within cylindrical protrusions on the top plate. The cake tray has a peripheral rim through which the illuminated miniature lights are visible. An inverted cake tray is positioned beneath the bottom plate such that the feet of the inverted tray engage downwardly extending protrusions on the bottom plate. An electric cord extends from the light string between the bottom plate and the inverted cake tray to be connected to another similar cake support or to an extension cord for connection to a power supply. The inverted tray may be disposed on a tabletop or on an underlying cake layer.

It is an object of the present invention to provide a cake support which visually highlights the supported cake.

It is another object of the present invention to provide an illuminated cake stand in which the lighting elements are shielded from the cake.

It is also an object of the present invention to provide a cake support which is rapidly assembled and easily transportable.

Further objects, features and advantages of the invention will be apparent from the following detailed description when taken in conjunction with the accompanying drawings.

DESCRIPTION OF THE PREFERRED EMBODIMENTS

Figure 1:
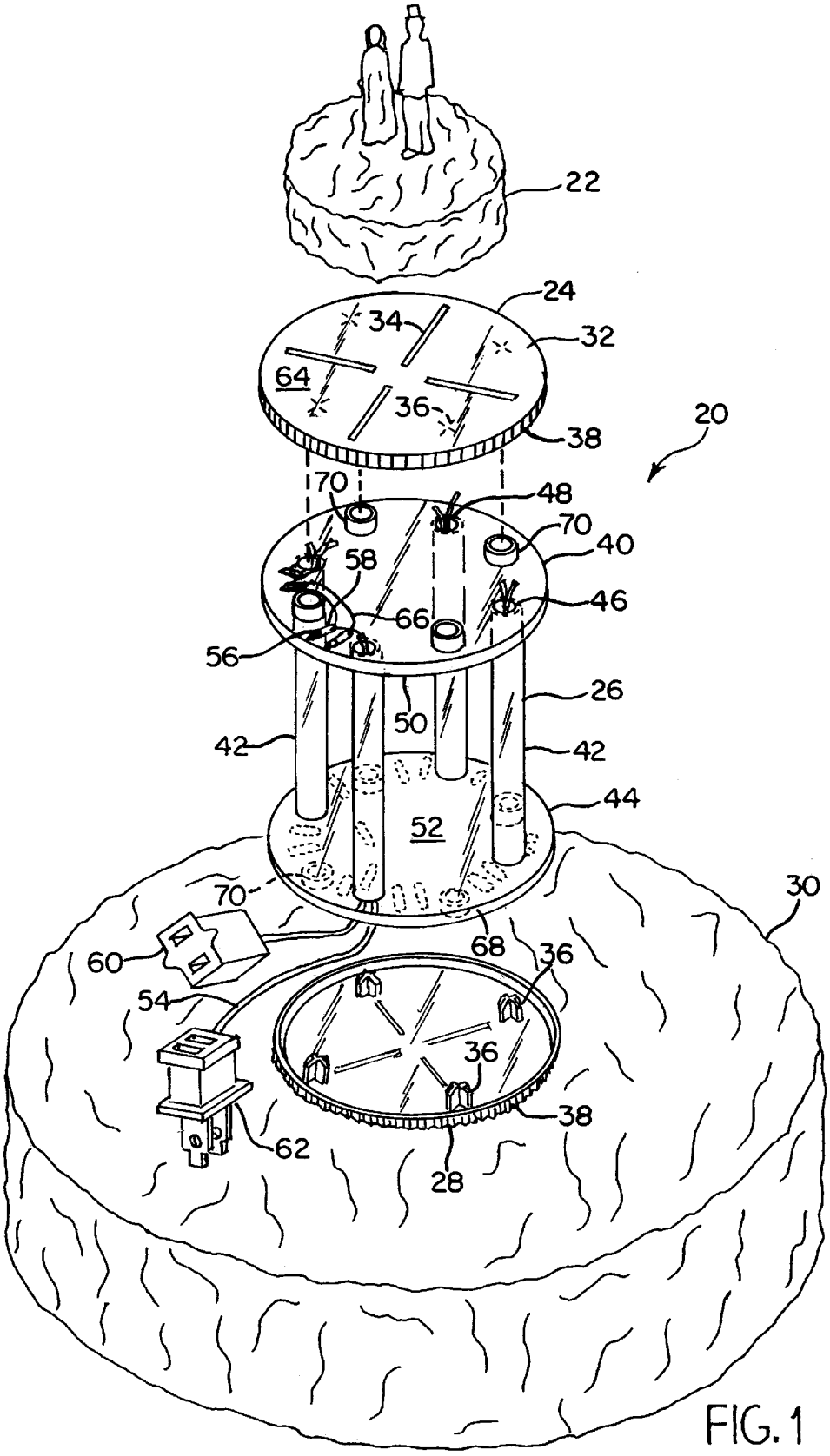
FIG. 1 is an exploded isometric view of the cake support of this invention.
Figure 3:
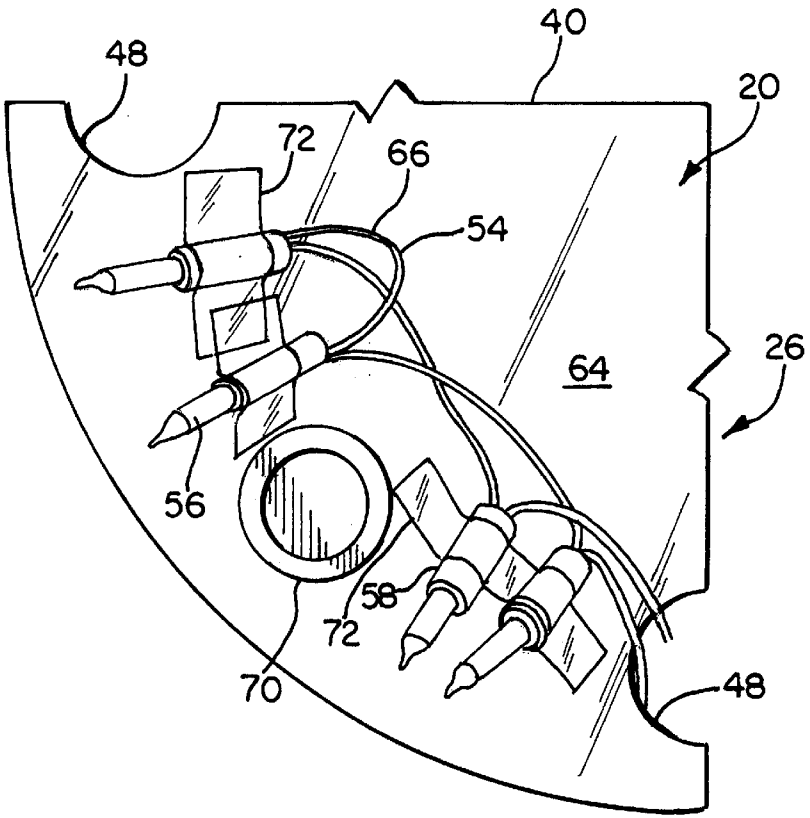
FIG. 3 is a fragmentary top plan view of the light assembly of the cake support of FIG. 1, showing the light string splayed out on one quadrant of the top plate.
Figure 2:
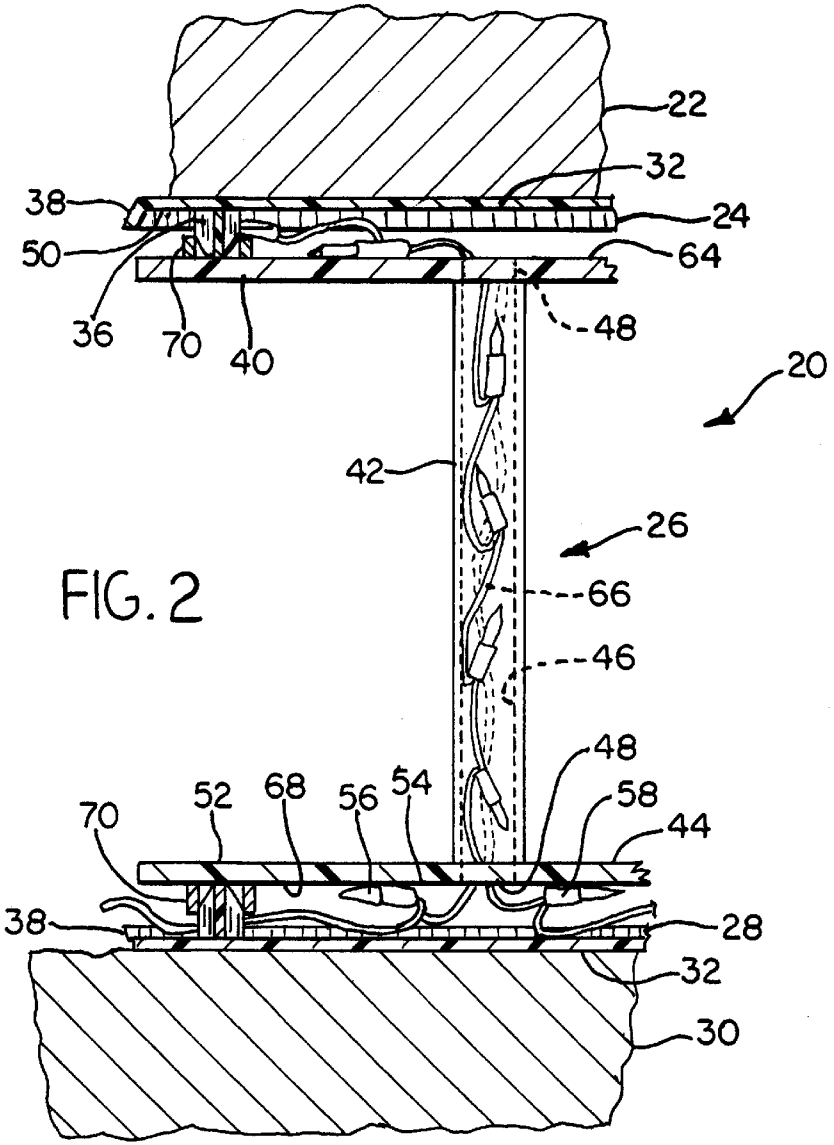
FIG. 2 is a fragmentary cross-sectional view of the cake support of FIG. 1.

Referring more particularly to FIGS. 1–3, wherein like numbers refer to similar parts, a cake support 20 is shown in FIG. 1. A cake layer 22 on a transparent plastic cake tray 24 is supported on an illuminated light assembly 26 which rests on an inverted cake tray 28 resting on the tabletop or an underlying cake layer 30.

The cake tray 24 may be a commercially available "crystal look" cake tray such as the ones manufactured by Wilton Enterprises Inc., of Woodridge, Ill. The cake tray 24 has a circular base 32 with upwardly protruding ribs 34 which assist in engaging the supported cake layer 22. A serrated rim 38 extends downwardly from the periphery of the tray base 32, and is approximately ⅜ inches tall. The rim 38 may have a faceted appearance to simulate the look of cut glass. Four X-shaped feet 36 extend downwardly from the base 32 of the tray. As shown in FIG. 2, the feet 36 taper as they extend downwardly. The feet 36 are preferably longer than the height of the rim 38, for example about ¾ inches tall. The rim 38 is thus spaced slightly above the surface which engages the feet 36.

The cake tray 24 is supported by the light assembly 26. As shown in FIG. 1, the light assembly 26 has a circular top plate 40 which is connected by four tubular pillars 42 to a circular bottom plate 44. The top plate 40, bottom plate 44, and pillars 42, are preferably formed of transparent plastic, for example acrylic. For stiffness and crack resistance, the top plate and bottom plate are preferably about one quarter inch thick. Each pillar 42 is hollow and has portions defining a central channel 46. The top plate 40 and bottom plate 44 each have pillar entry holes 48 which are the same diameter as the pillar channels 46. The pillars may be about one inch in diameter, and have a wall thickness of about ⅛ in. The pillars 42 are glued to the underside 50 of the top plate 40 and to the upper surface 52 of the bottom plate 44. The pillars and plates together form a stiff supportive structure. A single string 54 of miniature lights 56, such as those sold under the trademark FLORA-LITES and manufactured by Flora-Lite Co., 209 Patricia Avenue, Clearwater, Fla. 33765-2543, provides illumination for the light assembly 26. The lights are preferably clear white lights, but may also be colored. As shown in FIG. 1, the string 54 is a single strand of three twisted wires from which miniature light housings 58 extend. For a dense illumination, the light housings are close together, for example about 3½ inches apart. One light assembly may have about fifty lights. For clarity in the illustrations, the triple strand has been shown schematically as a single wire. The string 54 is terminated at one end with a plug receptacle 60, and at the other end with a combination plug and plug receptacle 62. As shown in FIGS. 2 and 3, the string 54 is doubled over to form a loop which is passed through the channel 46 in a pillar 42 from the underside of the bottom plate 44 to the top surface of the top plate 40. The pillars are thus illuminated by a number of lights extending through the channels 46. The lights 56 on each loop passed through each pillar 42 are splayed out upon the top surface 64 of the top plate 40 to illuminate one quadrant of the top plate. The lights 56 may be held in place on the top surface 64 by strips of adhesive tape 72 applied over the light housings or the wires. The connecting portions of the light string 54 between the loops 66 are splayed out on the underside 68 of the bottom plate.

To provide a convenient and secure, yet readily separable, connection between the light assembly and the cake tray 24 and the inverted cake tray 28, four cylindrical rings 70 are glued to the top surface 64 of the top plate 40, and to the bottom surface 68 of the bottom plate. The rings 70 form vertically extending protrusions which engage with the feet 36 on the adjacent cake trays 24, 28.

Typically a baker or caterer will prepare a wedding cake at a location remote from the site of the reception. The layers of the cake may be shipped to the reception hall disengaged from the light assembly. The wedding cake is than assembled by stacking the layers with intervening light assemblies. The light assembly 26 rests directly on the protruding feet 36 of the inverted cake tray 28 and is securely supported thereon. Even mild vibration of the table will not unduly displace the light assembly from the underlying inverted cake tray. The upper layer of cake 22 is carried on the upper cake tray 24 which is engaged with the top plate 40 of the light assembly 26. The light string plug 62 is connected to an extension cord, not shown, and the extension cord is plugged into a wall socket to illuminate the light assembly. If multiple light assemblies are to be used in a single wedding cake or collection of wedding cake layers, the light string receptacle of one light assembly may be connected to the combination plug and receptacle of another light assembly.

In nearly all circumstances, cake supports are not sold with the cakes, but are rented to the purchaser of the cake for return after the reception is over. The cake support 20 is readily disassembled after the cake has been consumed, with the cake tray 24 easily separated from the light assembly. Because the cake does not directly touch the light assembly, the light string is substantially protected from contamination by cake, and is readily prepared for use in another cake assembly.

It should be noted that although the cake tray, the top and bottom plates, and the inverted cake tray have been shown as circular or cylindrical, these parts may also be square, heart-shaped, rectangular, or other shape to conform to the shapes of the supported cake layers. Furthermore, although the top plate, bottom plate, and pillars of the light assembly have been described above as transparent, they may also be formed of colored transparent plastic, translucent plastic, or other material through which the illuminated lights will be visible. Moreover, although four pillars have been described as extending between the top plate and the bottom plate, one, two, three, five, or more pillars may be employed. In addition, the top plate and the bottom plate may be of different sizes to accommodate different cake layer dimensions.

It is understood that the invention is not limited to the particular construction and arrangement of parts herein illustrated and described, but embraces such modified forms thereof as come within the scope of the following claims.

I claim:

1. A cake support comprising:

a bottom plate;

at least one pillar fixed to the bottom plate and extending upwardly from the bottom plate, the at least one pillar having portions defining a channel which extends through the pillar;

a top plate positioned above the bottom plate and fixed to the at least one pillar, wherein the top plate has portions defining a pillar entry bole which communicates with the pillar channel, and wherein the bottom plate has portions defining a pillar entry hole which communicates with the pillar channel;

a string of a plurality of electric lights, wherein at least one light is connected to the bottom plate, and wherein the string extends from the bottom plate through the pillar channel to the top plate wherein at least one light is connected to the top plate; and a cake tray positioned above the top plate and having a base for supporting a cake layer thereon, the cake tray having portions which extend downwardly to engage the top plate, the cake tray being supported on the top plate above the at least one light which is connected to the top plate, the cake tray being readily separable from the top plate, wherein the portions of the cake tray which extend downwardly define a plurality of downwardly protruding legs, and further comprising a plurality of rings which extend upwardly from the top plate, each ring receiving one of the cake tray legs.

2. The cake support of claim 1 wherein the top plate, the bottom plate, the at least one pillar, and the cake tray are formed of transparent plastic material.

3. The cake support of claim 1 further comprising:

an inverted cake tray positioned beneath the bottom plate, wherein the inverted cake tray has a base which engages a supporting surface, and a plurality of feet which extend upwardly from the inverted cake tray to engage the bottom plate; and a plurality of rings which extend downwardly from the bottom plate, each ring surrounding one of the inverted cake tray feet.

4. The cake support of claim 1 wherein at least two pillars extend between the bottom plate and the top plate, and wherein the string of lights extends from the bottom plate and up through each of the pillars and back down through each of the pillars such that the string of lights begins and terminates beneath the lower plate.

5. The cake support of claim 1 wherein the at least one pillar is connected to the top plate and the bottom plate by adhesive bonding.

6. The cake support of claim 1 wherein the lights are fastened to the top plate and the bottom plate by strips of adhesive tape.

7. The cake support of claim 1 wherein the cake tray is transparent and has a peripheral downwardly extending rim.

8. A cake support comprising:

a transparent bottom plate;

a plurality of transparent pillars fixed to the bottom plate and extending upwardly from the bottom plate, each pillar having portions defining an upwardly extending channel;

a transparent top plate positioned above the bottom plate and fixed to each of the pillars, wherein the top plate has portions defining a plurality of pillar entry holes, each pillar entry hole overlying a pillar channel, and wherein the bottom plate has portions defining a plurality of pillar entry holes, each underlying a pillar channel;

a string of a plurality of electric lights, wherein at least one light is connected to the bottom plate, and wherein the string extends from the bottom plate through the pillar channel to the top plate, at least one light being positioned in each channel, and wherein at least one light is connected to the top plate; and a cake tray positioned above the top plate and having a base for supporting a cake layer thereon, wherein a plurality of legs extend downwardly from the base to engage the top plate; and portions of the top plate which extend upwardly to surround the legs of the cake tray, to thereby restrain shifting of the cake tray on the top plate, the cake tray being readily separable from the top plate.

9. The cake support of claim 8 further comprising:

an inverted cake tray positioned beneath the bottom plate, wherein the inverted cake tray has a base which engages a supporting surface, and a plurality of feet which extend upwardly from the inverted cake tray to engage the bottom plate; and a plurality of rings extending downwardly from the bottom plate, each ring surrounding one of the inverted cake tray feet.

10. An illuminated cake assembly, comprising:

a lower layer of cake;

an inverted cake tray positioned on the lower layer of cake;

a bottom plate supported on the inverted cake tray;

a plurality of transparent pillars connected to the bottom plate and extending upwardly from the bottom plate, each pillar having portions defining an upwardly extending channel;

a top plate positioned above the bottom plate and fixed to each of the pillars;

a string of a plurality of electric lights, wherein at least one light is connected to the bottom plate, and wherein the string extends from the underside of the bottom plate through the pillar channel to the top surface of the top plate, at least one light being positioned in each channel, and wherein at least one light is connected to the top plate;

a cake tray supported on the top plate and having a base which is supported above the electric lights on the top plate, wherein the cake tray has a plurality of downwardly protruding legs, and further comprising a plurality of rings which extend upwardly from the top plate each ring receiving one of the cake tray legs;

an upper cake layer supported on the cake tray; and an electric plug extending from the string of electric lights and in electrical communication with a source of electric power to illuminate the electric lights and to thereby provide illumination in the pillars and between the upper cake layer and the lower cake layer.

11. The cake support of claim 10 wherein the top plate, the bottom plate, the inverted cake tray, and the cake tray are formed of transparent plastic material.

12. The cake support of claim 10, wherein the inverted cake tray has a base which engages the lower layer of cake, and a plurality of feet extend upwardly from the inverted cake tray to engage the bottom plate, and a plurality of rings extend downwardly from the bottom plate, each ring surrounding one of the inverted cake tray feet.

13. The cake support of claim 10 wherein the string of lights extends from the bottom plate and up through each of the pillars and back down through each of the pillars such that the string of lights begins and terminates beneath the lower plate.

14. The cake support of claim 10 wherein the pillars are connected to the top plate and the bottom plate by adhesive bonding.

15. The cake support of claim 10 wherein the lights are fastened to the top plate and the bottom plate by strips of adhesive tape.

16. The cake support of claim 10 wherein the cake tray is transparent and has a peripheral downwardly extending rim which is spaced above the top plate, and wherein the inverted cake tray is transparent and has a peripheral upwardly extending rim which is spaced below the bottom plate.

* * * * *

UNITED STATES PATENT AND TRADEMARK OFFICE

CERTIFICATE OF CORRECTION

PATENT NO. : 6,170,961 B1
DATED : January 9, 2001
INVENTOR(S) : Joanne J. Knoch

It is certified that error appears in the above-identified patent and that said Letters Patent is hereby corrected as shown below:

Column 4,
Line 29, "bole" should be -- hole --.

Column 6,
Line 17, "plate each" should be -- plate, each --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*